US009927206B1

(12) United States Patent
Smith

(10) Patent No.: US 9,927,206 B1
(45) Date of Patent: Mar. 27, 2018

(54) RECOIL REDUCING STOCK SYSTEM

(71) Applicant: Vista Outdoor Operations LLC, Clearfield, UT (US)

(72) Inventor: Paul N. Smith, Bozeman, MT (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 14/996,972

(22) Filed: Jan. 15, 2016

Related U.S. Application Data

(60) Provisional application No. 62/104,549, filed on Jan. 16, 2015, provisional application No. 62/104,573, filed on Jan. 16, 2015.

(51) Int. Cl.
*F41C 23/08* (2006.01)
*F41C 23/16* (2006.01)
*F41C 23/18* (2006.01)

(52) U.S. Cl.
CPC ..... *F41C 23/08* (2013.01); *F41C 23/16* (2013.01); *F41C 23/18* (2013.01)

(58) Field of Classification Search
CPC ..... F42C 23/06; F42C 23/08; F42C 23/18; F42C 23/20; F41C 23/06; F41C 23/08; F41C 23/18; F41C 23/20
USPC ..... 42/95
See application file for complete search history.

(56) References Cited

U.S. PATENT DOCUMENTS

| | | | | |
|---|---|---|---|---|
| 1,334,467 | A * | 3/1920 | Moller | F41C 23/06 42/74 |
| 1,351,141 | A | 8/1920 | Thompson | |
| 1,964,649 | A | 6/1934 | Stetson | |
| 2,731,753 | A | 1/1956 | Mathieu | |
| 2,754,608 | A | 7/1956 | Stieffel, Jr. | |
| 2,831,404 | A | 4/1958 | Sampson et al. | |
| 3,001,312 | A | 9/1961 | Campbell | |
| 3,039,222 | A | 6/1962 | Hoge | |
| 3,105,411 | A | 10/1963 | Browning | |
| 3,176,424 | A | 4/1965 | Hoge | |
| 3,209,482 | A | 10/1965 | Kuzma et al. | |

(Continued)

FOREIGN PATENT DOCUMENTS

| | | |
|---|---|---|
| EP | 1122507 | 4/1991 |
| EP | 1657518 | 5/2006 |
| EP | 2293006 B1 | 11/2012 |

OTHER PUBLICATIONS

Givology [online] "The World's Largest Selection of Gun Parts & Accessories for Sale" First Accessed on Nov. 20, 2013. Retrieved from the Internet: http://www.gunaccessories.com/RecoilBuffers (15 pgs.).

(Continued)

*Primary Examiner* — Stephen Johnson
(74) *Attorney, Agent, or Firm* — Christensen, Fonder, Dardi & Herbert PLLC

(57) ABSTRACT

A recoil reduction system for a firearm. In some embodiments, the recoil reduction system includes a biasing element and a butt pad assembly configured to deform substantially proportionate to each other during a recoil event. The biasing element and/or butt pad assembly may include a spring-type element or, alternatively, a dampening device. The butt pad assembly may include an open cell butt pad having a hardness that is substantially higher than conventional butt pads.

15 Claims, 5 Drawing Sheets

(56) References Cited

U.S. PATENT DOCUMENTS

| | | | | |
|---|---|---|---|---|
| 3,233,354 | A | 2/1966 | Ahearn | |
| 3,405,470 | A | 10/1968 | Wesemann | |
| 3,492,749 | A | 2/1970 | Vironda | |
| 3,707,797 | A | 1/1973 | Ruth | |
| 3,714,726 | A | 2/1973 | Braun | |
| 3,754,344 | A * | 8/1973 | Spiliotis | F41C 23/06 42/74 |
| 4,112,605 | A | 9/1978 | Staub | |
| 4,439,943 | A * | 4/1984 | Brakhage | F41C 23/06 42/74 |
| H217 | H | 2/1987 | Jorczak | |
| 4,663,877 | A | 5/1987 | Bragg | |
| 4,769,937 | A | 9/1988 | Gregory et al. | |
| 4,774,873 | A | 10/1988 | Shoales | |
| 4,785,922 | A | 11/1988 | Kiehart | |
| 4,867,038 | A | 9/1989 | Metz | |
| 4,910,904 | A | 3/1990 | Rose | |
| 4,986,018 | A | 1/1991 | McDonald, Jr. | |
| 5,031,348 | A | 7/1991 | Carey | |
| 5,235,764 | A | 8/1993 | Perazzi | |
| 5,305,539 | A | 4/1994 | Von Kuster | |
| 5,343,649 | A | 9/1994 | Petrovich | |
| 5,362,046 | A | 11/1994 | Sims | |
| 5,375,360 | A | 12/1994 | Vatterott | |
| 5,392,553 | A | 2/1995 | Carey | |
| 5,410,833 | A | 5/1995 | Paterson | |
| 5,513,730 | A | 5/1996 | Petrovich et al. | |
| D376,188 | S | 12/1996 | Riecken | |
| 5,598,904 | A | 2/1997 | Spyche, Jr. | |
| 5,634,289 | A | 6/1997 | Wascher | |
| 5,669,168 | A | 9/1997 | Perry | |
| 5,722,195 | A | 3/1998 | Bentley et al. | |
| 5,726,377 | A | 3/1998 | Harris et al. | |
| 5,827,992 | A | 10/1998 | Harris et al. | |
| 5,909,002 | A | 6/1999 | Atchisson | |
| 5,974,718 | A | 11/1999 | Bentley et al. | |
| 5,979,098 | A | 11/1999 | Griggs | |
| 6,164,002 | A | 12/2000 | Troncoso | |
| 6,305,115 | B1 | 10/2001 | Cook | |
| 6,467,212 | B1 | 10/2002 | Apel | |
| 6,481,143 | B2 | 11/2002 | McCarthy | |
| 6,530,563 | B1 | 3/2003 | Miller et al. | |
| 6,560,911 | B2 | 5/2003 | Sharp | |
| 6,564,493 | B1 | 5/2003 | Forman | |
| 6,594,935 | B2 | 7/2003 | Beretta | |
| 6,637,141 | B1 | 10/2003 | Weatherby et al. | |
| 6,651,371 | B2 | 11/2003 | Fitzpatrick et al. | |
| 6,662,485 | B2 | 12/2003 | Kay | |
| 6,684,547 | B2 | 2/2004 | Poff, Jr. | |
| 6,688,031 | B2 | 2/2004 | Steele | |
| 6,732,466 | B2 | 5/2004 | Bentley | |
| 6,758,126 | B1 | 7/2004 | Houtsma | |
| 6,761,102 | B2 | 7/2004 | Giza | |
| 6,834,455 | B2 | 12/2004 | Burigana | |
| 6,834,456 | B2 | 12/2004 | Murello | |
| 6,848,351 | B1 | 2/2005 | Davies | |
| 6,874,267 | B2 | 4/2005 | Fitzpatrick et al. | |
| 6,889,461 | B2 | 5/2005 | Vignaroli et al. | |
| 6,976,333 | B2 | 12/2005 | Sims | |
| 7,025,052 | B2 | 4/2006 | Schavone | |
| 7,055,277 | B2 | 6/2006 | Sims | |
| 7,121,032 | B2 | 10/2006 | Daul et al. | |
| 7,124,529 | B1 | 10/2006 | Havelka, Jr. | |
| 7,131,367 | B1 | 11/2006 | Boerschig et al. | |
| 7,152,355 | B2 | 12/2006 | Fitzpatrick et al. | |
| 7,152,356 | B2 | 12/2006 | Sims | |
| 7,162,822 | B1 | 1/2007 | Heayn et al. | |
| 7,273,002 | B1 | 9/2007 | Rogers | |
| 7,380,487 | B2 | 6/2008 | Mantas | |
| 7,478,495 | B1 | 1/2009 | Alzamora et al. | |
| 7,493,845 | B2 | 2/2009 | Mantas | |
| 7,536,819 | B2 | 5/2009 | Popikow | |
| 7,581,954 | B2 | 9/2009 | Schavone | |
| 7,673,413 | B2 | 3/2010 | Bentley | |
| 7,681,351 | B2 | 3/2010 | Bucholtz et al. | |
| 7,775,150 | B2 | 8/2010 | Hochstrate et al. | |
| 7,793,453 | B1 | 9/2010 | Sewell, Jr. et al. | |
| 7,823,313 | B2 | 11/2010 | Faifer | |
| 7,827,722 | B1 | 11/2010 | Davies | |
| 7,849,626 | B2 | 12/2010 | Fluhr | |
| 7,877,917 | B2 | 2/2011 | Cinciu | |
| 7,926,216 | B2 | 4/2011 | Bentley | |
| 7,930,849 | B2 | 4/2011 | Abraham et al. | |
| 7,938,055 | B2 | 5/2011 | Hochstrate et al. | |
| 7,963,203 | B1 | 6/2011 | Davies | |
| 7,966,760 | B2 | 6/2011 | Fitzpatrick et al. | |
| 7,984,580 | B1 | 7/2011 | Giauque et al. | |
| 7,992,337 | B2 | 8/2011 | Ochoa | |
| 8,037,806 | B2 | 10/2011 | Davies | |
| 8,051,593 | B2 | 11/2011 | Vesligaj | |
| 8,074,391 | B2 | 12/2011 | Petrů j | |
| 8,117,958 | B2 | 2/2012 | Hochstrate et al. | |
| 8,127,483 | B2 | 3/2012 | Kincel | |
| 8,176,668 | B2 | 5/2012 | Simms et al. | |
| 8,176,835 | B1 | 5/2012 | Cottle | |
| 8,205,371 | B1 | 6/2012 | Cook et al. | |
| 8,286,382 | B2 | 10/2012 | Vesligaj | |
| 8,296,984 | B2 | 10/2012 | Kincel | |
| 8,296,986 | B1 | 10/2012 | Cook et al. | |
| 8,297,175 | B1 | 10/2012 | Davies | |
| 8,327,569 | B2 | 12/2012 | Kincel | |
| 8,341,868 | B2 | 1/2013 | Zusman | |
| 8,356,542 | B2 | 1/2013 | Cottle et al. | |
| 8,387,297 | B2 | 3/2013 | deBrun et al. | |
| 8,413,361 | B2 | 4/2013 | Quaedpeerds et al. | |
| 8,430,015 | B2 | 4/2013 | Faifer | |
| 8,434,252 | B2 | 5/2013 | Holmberg | |
| 8,448,562 | B2 | 5/2013 | Cottle | |
| 8,468,729 | B1 | 6/2013 | Sylvester | |
| 8,474,169 | B2 | 7/2013 | Cottle et al. | |
| 8,505,226 | B2 | 8/2013 | Vesligaj | |
| 8,505,433 | B2 | 8/2013 | Hochstrate et al. | |
| 8,555,541 | B2 | 10/2013 | Ingram | |
| 8,561,338 | B2 | 10/2013 | Chvala | |
| 8,607,687 | B2 | 12/2013 | Cottle | |
| 8,661,963 | B2 | 3/2014 | Patel | |
| 8,671,608 | B2 | 3/2014 | Vesligaj | |
| 8,677,664 | B2 | 3/2014 | Caravaggi et al. | |
| 8,677,669 | B1 | 3/2014 | Vesligaj | |
| 8,689,672 | B2 | 4/2014 | Cassels | |
| 8,707,850 | B1 | 4/2014 | Davies | |
| 8,720,099 | B1 | 5/2014 | Sisk | |
| 8,752,472 | B1 | 6/2014 | Lukman et al. | |
| 8,776,421 | B1 | 7/2014 | Vesligaj | |
| 8,782,941 | B2 | 7/2014 | Zusman | |
| 8,783,160 | B2 | 7/2014 | Hochstrate et al. | |
| 8,800,189 | B2 | 8/2014 | Fitzpatrick et al. | |
| 8,806,791 | B2 | 8/2014 | Cottle | |
| 8,815,138 | B2 | 8/2014 | Howe et al. | |
| 8,844,185 | B2 | 9/2014 | Jarboe | |
| 8,863,428 | B2 | 10/2014 | Vesligaj | |
| 8,904,692 | B2 | 12/2014 | Ballard | |
| 8,943,726 | B2 | 2/2015 | Kincel | |
| 8,950,098 | B2 | 2/2015 | Sims et al. | |
| 9,021,727 | B2 | 5/2015 | Butler | |
| 2005/0246931 | A1 | 11/2005 | Poff, Jr. | |
| 2007/0089347 | A1 * | 4/2007 | Webber | F41A 11/02 42/75.03 |
| 2010/0229444 | A1 | 9/2010 | Faifer | |
| 2010/0251587 | A1 | 10/2010 | Kincel | |
| 2011/0113666 | A1 | 5/2011 | Latimer | |
| 2011/0138668 | A1 | 6/2011 | Thomas | |
| 2014/0165443 | A1 | 6/2014 | Johnston | |

OTHER PUBLICATIONS

Recoil Systems [online] "The ISIS II Recoil reducer is the only unit of its kind and is manufactured in the UK. The unit was developed and patented in 2001 and has sold very successfully throughout the

(56) References Cited

OTHER PUBLICATIONS world since" First Accessed on Nov. 20, 2013. Retrieved from the Internet: http://www.recoilsystems.com/principle.asp (2 pgs.).

* cited by examiner

RECOIL REDUCING STOCK SYSTEM

RELATED APPLICATIONS

This application claims the benefit of U.S. provisional patent application No. 62/104,549, filed Jan. 16, 2015, and U.S. provisional patent application No. 62/104,573, filed Jan. 16, 2015, the disclosures of which are hereby incorporated by reference herein in their entirety.

BACKGROUND

Recoil abatement systems are commonly employed in firearms, ranging from compliant butt pads to spring-loaded or shock dampening components coupled to the buttstock. More recent recoil abatement systems include "sliding stock" systems, featuring components internal to the buttstock that enable enables the receiver of the firearm to translate within the buttstock. Some stock systems, irrespective of whether they provide recoil abatement, feature the ability to readily adjust the overall length.

Conventional sliding stock systems can be limited in the amount of relative translation between the receiver and the buttstock, causing the buttstock to abruptly jolt the operator at the end of the recoil stroke.

In view of this shortcoming, improvements to sliding stock systems would be welcomed.

SUMMARY

Recoil reduction system concepts are disclosed that may be utilized with a variety of firearms, such as shot guns and rifles. In some embodiments, the recoil reduction systems are provided as retrofit kits for installation on existing firearms. In other embodiments, the recoil reduction systems are incorporated into factory-supplied firearms.

Various embodiments of the disclosed recoil reduction system provide dual deformable elements, a first of the deformable elements adapted to absorb a first fraction of a total recoil deflection without displacing the hand of the operator, and a second of the deformable elements adapted to absorb a second fraction of the total recoil deflection that does displace the hand of the operator. In bifurcating the total recoil deflection in this way, a hand grip of the recoil reduction system may be dimensioned to accommodate an ordinary hand size while providing a gradual, less jarring recoil to the shoulder of the operator.

Some conventional sliding stock systems include a pistol or hand grip and are arranged so that the receiver recoils into the pistol grip. An advantage of such systems is that, over the compensated stroke of the recoil, the pistol grip does not recoil into the hand of the operator, thereby providing greater stability and control of the firearm. However, this arrangement limits the length of the compensation of the recoil because the stroke cannot exceed the longitudinal dimension (i.e., the dimension along the x-axis of FIG. 1) of the pistol grip. At some point, simply enlarging the longitudinal dimension of the pistol grip to provide more slide length therein is not a solution because the enlarged dimension would cause the pistol grip to be too big for gripping with a normal sized hand. Accordingly, these systems do not fully accommodate recoil events that exceed the limited stroke length of the system. When these sliding stock systems reach the maximum stroke length, the remaining kinetic energy generates an impact shock that is absorbed by the operator. As a result, these systems can still cause the pistol grip to kick back against the hand of the operator for high powered loads, as well as against the shoulder of the operator.

To compensate, such sliding stock systems may include a conventional butt pad in an effort to at least mitigate the impact shock against the shoulder of the operator. However, such remedy are historically of marginal utility. Conventional butt pads are typically made of a compliant or soft material having a hardness typically in the range of 30 to 70 Shore 00 hardness. Such butt pads yield freely during the initial phases of the impact shock, but may become compressed and unyielding before the recoil stroke of a recoil event is complete, so that the operator will still experience a sudden impact shock.

Various embodiments of the disclosure are directed to abatement of the recoil beyond the stroke length of the sliding stock. To this end, the recoil reduction system includes a biasing element and a butt pad assembly configured to deform substantially proportionate to each other during a recoil event. This draws out the fraction of the recoil compensated by the butt pad over a longer time period, so that the operator experiences a less abrupt buildup of recoil force imparted by the butt pad against the shoulder and the handgrip against the hand. So, while the butt pad and handgrip will translate backward into the operator, such translation is comparatively gradual in relation to the more violent shock impact generated by conventional sliding stock systems.

In some embodiments, the biasing element and/or butt pad assembly includes a spring-type element or, alternatively, a dampening device. The butt pad assembly may include an open cell butt pad having a hardness that is substantially higher than conventional butt pads. In some embodiments, the recoil reduction includes a buffer tube housed within a buttstock, and a deformable structure for setting a clearance tolerance between the buffer tube and the buttstock to reduce lateral play while enabling smooth translation therebetween. In some embodiments, a guide pin and/or skid projections provide interference between the sliding components of the recoil reduction system when in a battery position, while releasing the interference during a recoil event.

In some embodiments, favorable performance of the butt pad assembly is realized by material and structural characteristics that linearize the deflection of the butt pad assembly over the time period of the recoil event by promoting rotation of the internal structural elements as opposed to compression of the internal structural elements. A surprising result of this philosophy is the use of harder rather than softer materials for the butt pad, which favors rotation of structural elements over compressive deformation of the structural elements. Favorable structural characteristics can be characterized in several ways, including the type of structure (e.g., various polygonal structures, relationship between linkages within that structure), a porosity of such structures, and dimensionless characteristics of the open cell structures. Favorable combinations of hardness and structure of the butt pad assembly can be more generally characterized by spring constant, compressive displacement, and/or energy capacity. Favorable characteristics of the overall may be characterized in terms of the spring constants and energy capacity of both the butt pad assembly and the sliding stock, as well as a ratio of the compressive displacements of the sliding member to the butt pad assembly.

Structurally, a recoil reduction system is disclosed that includes a buttstock, a slide member for coupling to a receiver, a biasing element operatively coupled with the buttstock and the slide member, and a butt pad coupled to a proximal end of the buttstock. In one embodiment, the biasing element is configured for a compressive displacement that is at least 1.5 times and not more than 5 times a compressive displacement of the butt pad during a recoil event.

A butt pad for a buttstock of a firearm is also disclosed, the butt pad including a lattice structure defining an open cell structure that is exposed to ambient air, the lattice structure defining a plurality of primary polygonal structures including a combination of perpendicular linkages and canted linkages joined at junctions. In one embodiment, the butt pad is formed of a material having a Shore A hardness of at least 50 and not more than 70.

DETAILED DESCRIPTION

Figure 1:
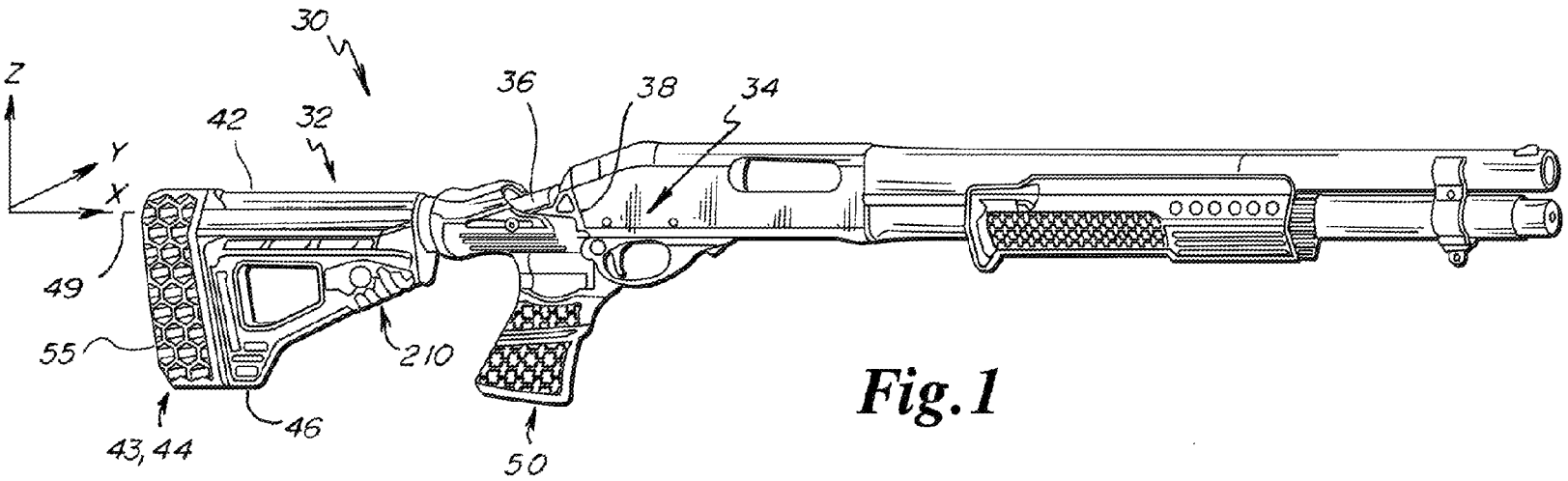
FIG. 1 is a perspective view of a modified firearm utilizing a recoil reduction system in an embodiment of the disclosure.

Referring to FIG. 1, a modified firearm 30 implementing a recoil reduction system 32 is depicted in an embodiment of the disclosure. The firearm 30 includes a receiver 34 of a standard firearm, for example a Remington Model 870™ Wingmaster® (depicted). The recoil reduction system 32 includes a slide member 36 having a front or distal end 38 configured for mounting to the specific receiver 34 and operatively coupled to a buttstock 42. A butt pad assembly 43 is operatively coupled to a rear or proximal end 46 of the buttstock 38. In various embodiments, the butt pad assembly 43 includes an open cell butt pad 44, as depicted in FIG. 1.

A biasing element 48 (FIG. 2) is operatively coupled with the slide member 36 and the buttstock 42 to exert a biasing force therebetween, thereby urging the slide member 36 forward relative the buttstock 42. In one embodiment, the recoil reduction system 32 includes a hand grip assembly 50 mounted to the buttstock 42, the slide member 36 extending into the hand grip assembly 50 and being translatable along an actuation axis 49. In one embodiment, the biasing element 48 is housed in the hand grip assembly 50.

Figure 2:
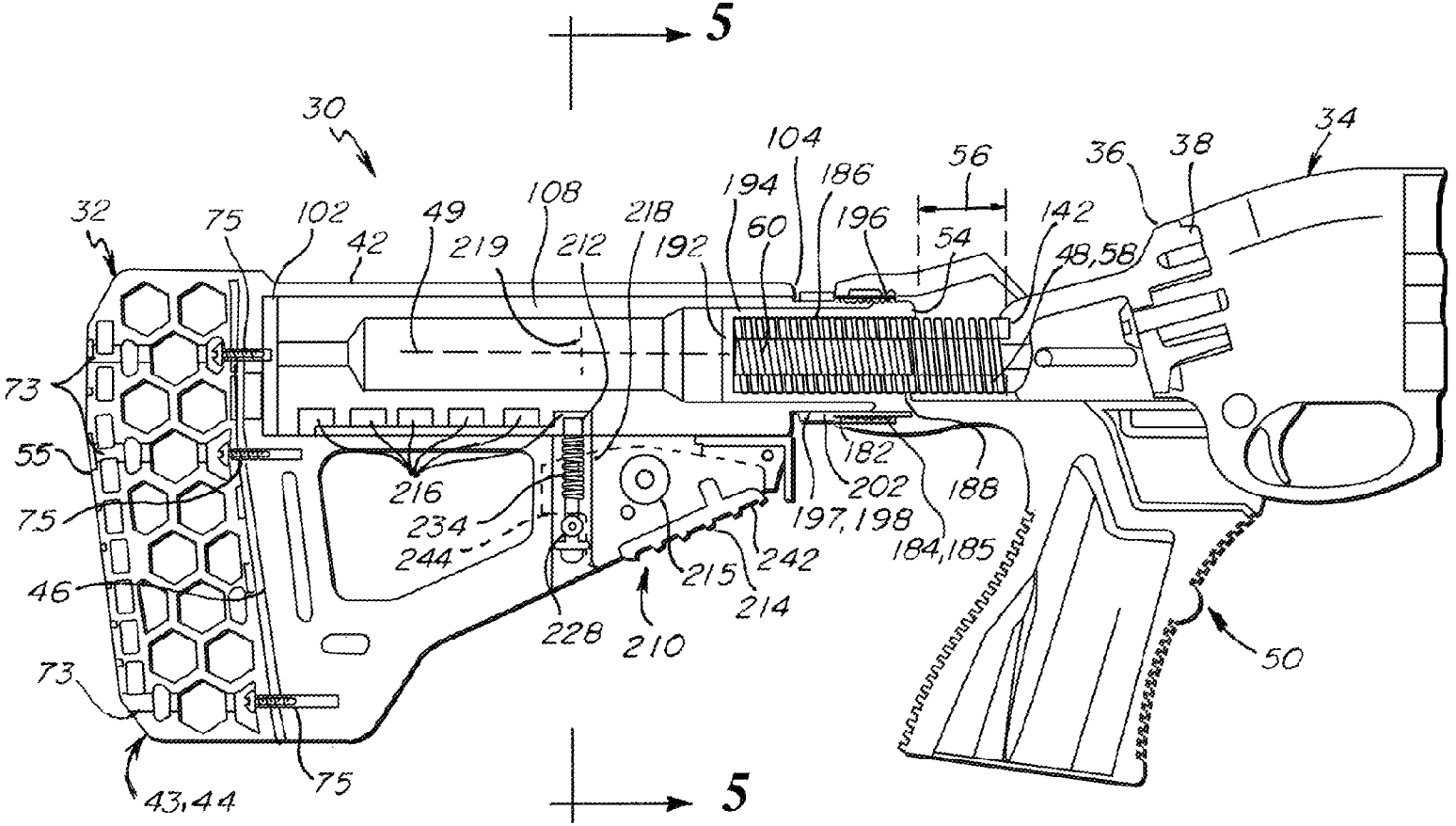
FIG. 2 is a sectional view of the recoil reduction system of FIG. 1 in a battery configuration in an embodiment of the disclosure.
Figure 3:
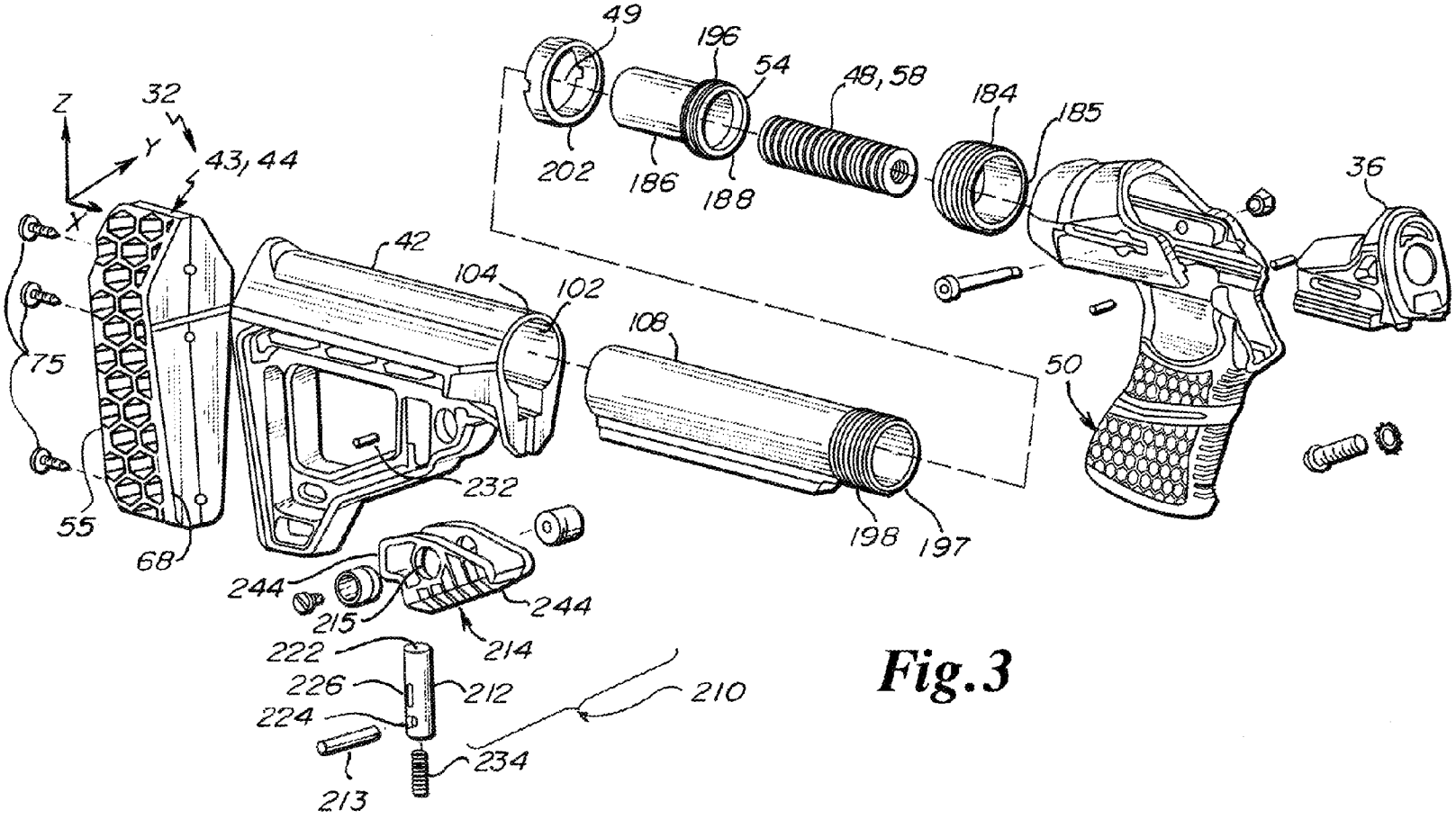
FIG. 3 is an exploded view of the recoil reduction system of FIG. 1 in an embodiment of the disclosure.

Referring to FIGS. 2 and 3, the recoil reduction system 32 is presented in an embodiment of the disclosure. In one embodiment, the recoil reduction system 32 includes a rearward or proximal stop 54 that limits the rearward or proximal travel of the slide member 36 relative to the buttstock 42 during firing of the modified firearm 30. (In the depicted embodiment, the proximal stop 54 is a distal end of a spring tube 186, described in greater detail below.) Herein, "proximal" refers to a relative direction or location that is towards a shouldered face 55 of the butt pad assembly 43, while "distal" refers to a relative direction or location that is away from the shouldered face 55.

A maximum bias member displacement 56 (FIG. 2) along the actuation axis 49 is thereby defined between the proximal stop 54 and the slide member 36 when in a battery configuration. In various embodiments, the biasing element 48 is configured for a substantially linear spring rate over the maximum bias member displacement 56. In various embodiments, the spring rate is in the range of 120 to 200 lbf/in inclusive. (Herein, a range that is said to be "inclusive" includes the end point values of the stated range, as well as the values between the end point values.) In some embodiments, the spring rate is in the range of 150 to 170 lbf/in inclusive.

In various embodiments, the biasing element 48 comprises a coiled spring 58. In some embodiments, the biasing element 48 also includes a second spring 60 nested within the coiled spring 58. By nesting springs in this manner, the springs act in parallel, providing a stiffer combined spring rate than either one of the springs 58, 60. In one non-limiting example, the coiled spring 58 is an ISO-204 die spring type having a spring rate of 25 N/mm and the second spring 60 is an ISO-203 die spring type having a spring rate of approximately 3.2 N/mm, for a combined spring rate of approximately 28 N/mm. Such springs are commercially available from, for example, Associated Spring Raymond of Maumee, Ohio, U.S.A. The coil spring(s) 58, 60 may be made of any suitable material available to the artisan, including carbon steel or a high resilience polymer. In other embodiments, the biasing element 48 includes some other suitably elastic member, such as a rubber cylinder (not depicted).

Figures 4, 4A, 4B:
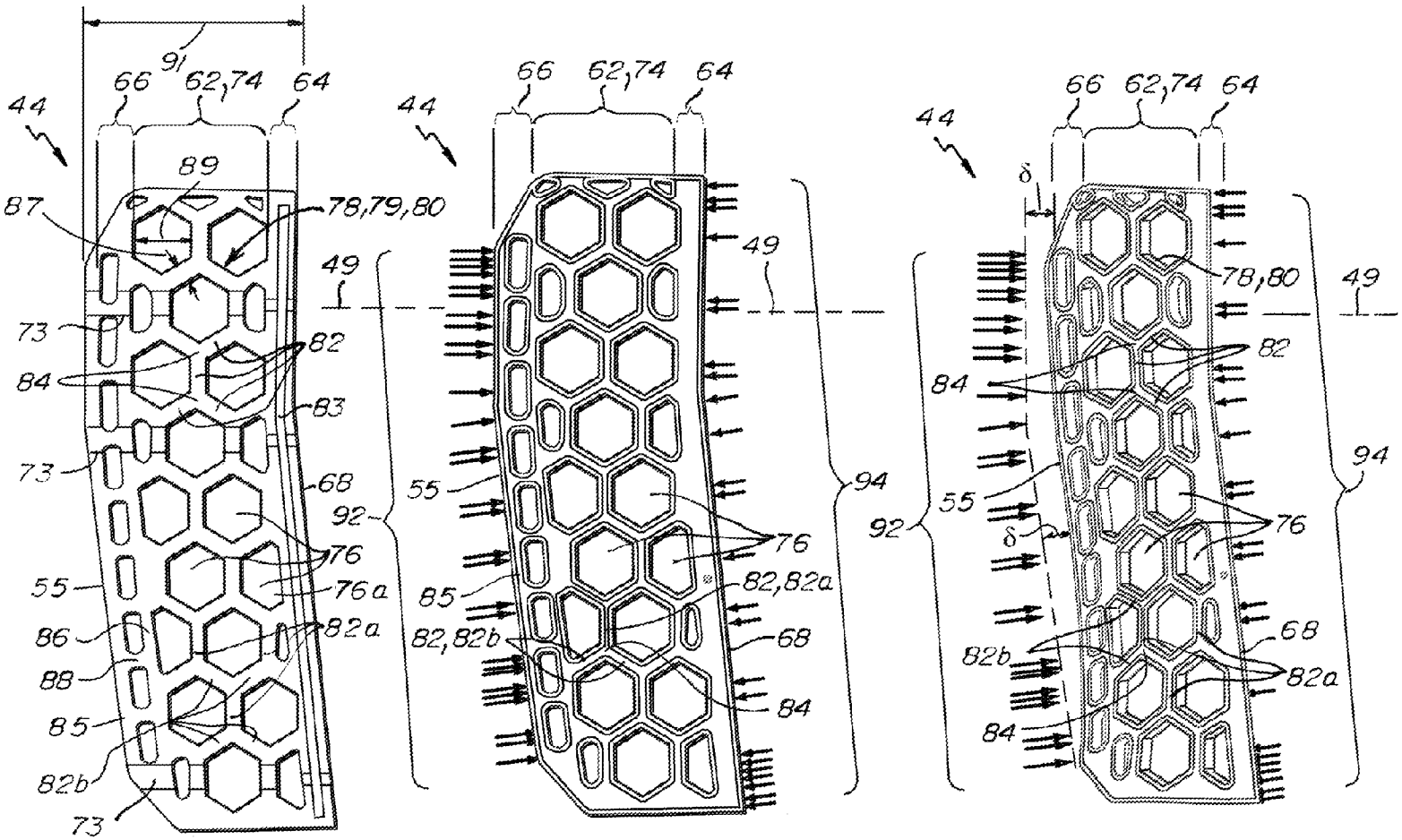
FIG. 4 is an elevation view of an open cell butt pad in an embodiment of the disclosure.
FIGS. 4A and 4B are elevation views of the open cell butt pad of FIG. 4 for a finite element analysis simulating a recoil event in an embodiment of the disclosure.

Referring to FIG. 4, the open cell butt pad 44 is depicted in isolation in an embodiment of the disclosure. In the depicted embodiment, the open cell butt pad 44 includes a core portion 62 that separates a mounting structure 64 and an end cap portion 66. The mounting structure 64 defines a distal face 68 of the open cell butt pad 44. The end cap portion 66 is disposed at the shouldered face 55 (proximal face) of the open cell butt pad 44 for registration against the shoulder or other anatomical component of an operator of the modified firearm 30. The open cell butt pad 44 may also define one or more access passages 73 to accommodate the passage of fasteners 75 (FIG. 2) for mounting of the open cell butt pad 44 to the buttstock 42.

The core portion 62 is an open cell structure 74 that defines a plurality of open cells 76 that are exposed to ambient air. That is, each of the open cells 76 of the open cell structure 74 is vented to ambient, for example by the absence of an exterior lateral skin, such that the open cell structure 74 defines a plurality of through-holes. In various embodiments, the open cells 76 extend laterally through the core portion 62 ("lateral" meaning parallel to any plane that is normal to the actuation axis 49).

The open cell butt pad 44 can be characterized as having a porosity or void fraction, defined as the ratio of the volume of the air that occupies the open cells 76 of the open cell butt pad 44 to the total volume of the open cell butt pad 44. In various embodiments, the porosity is in the range of 86% to 90% inclusive. In some embodiments, the porosity is in the range of 85% to 92% inclusive. In still other embodiments, the porosity is in the range of 80% to 95% inclusive.

In various embodiments, the open cell structure is defined by a lattice structure 78. The lattice structure 78 can be characterized as a network of linkages 82 joined at junctions 84, the linkages 82 and junctions 84 being unitary. In some embodiments, the lattice structure 78 defines a "honeycomb" structure 79, i.e., where the open cells 76 define at least part of a primary polygonal structure, as depicted in FIG. 4A. That is, some passages fully define the primary polygonal structure, while others, being interrupted by the boundaries of the open cell butt pad 44, form only a portion of the primary polygonal structure (e.g., open cell 76*a* of FIG. 4). In the depicted embodiment, the primary polygonal structure of the open cells 76 of the honeycomb structure 79 is a hexagonal structure 80. Other polygonal structures include triangular, diamond-shaped, pentagons, and octagons. In various embodiments, the lattice structure 78 is formed of a material having a Shore A hardness in the range of 55 to 65 inclusive. In some embodiments, the Shore A hardness is in the range of 50 to 70 inclusive. In still other embodiments, the Shore A hardness is in the range of 50 to 80 inclusive.

The mounting structure 64 of the open cell butt pad 44 may be profiled to complement the proximal end 46 of the buttstock 42. In one embodiment, the mounting structure 64 includes a plate 83 that is substantially rigid relative to the material of the open cell butt pad 44. The end cap portion 66 may be unitary or integrally formed with the lattice structure 78 of the core portion 62. In one embodiment, the end cap portion 66 includes a proximal plate portion 85 and a distal plate portion 86 separated by a plurality of web portions 88, the plate portions 85, 86 and web portions 88 being of the same material and hardness as the core portion 62.

For the hexagonal structure 80 of the depicted open cell butt pad 44, the linkages 82 fall into two general categories: perpendicular linkages 82*a*, which extend substantially perpendicular to the actuation axis 49 between junctions 84; and canted linkages 82*b*, which extend at acute angles relative to the actuation axis 49 between junctions 84. A third category of linkages are parallel linkages that extend substantially parallel to the actuation axis 49. While the hexagonal structure 80 does not provide examples of parallel linkages, the web portions 88 approximate such parallel linkages between the proximal and distal plate portions 84 and 86.

In certain embodiments, the primary polygonal structure of the open cells 76 of the lattice structure 78 define an internal dimension 89 in the longitudinal directions of the primary polygonal structure that is nominally 0.47 inches. In various embodiments, the internal dimension 89 is in a range of 0.45 inches to 0.5 inches inclusive; in some embodiments, in a range of 0.4 inches to 0.55 inches inclusive. In some embodiments, a nominal thickness 87 of the linkages 82 that define the primary polygonal structure is nominally 0.125 inches. In some embodiments, the nominal thickness 87 is in a range of 0.1 inches to 0.15 inches inclusive; in some embodiments, in a range of 0.063 inches to 0.188 inches inclusive; in some embodiments, in a range of 0.032 inches to 0.25 inches inclusive.

In various embodiments, open cells 76 of the lattice structure 78 can be characterized dimensionlessly by a void-to-thickness ratio, defined as the ratio of the internal dimension 89 in the longitudinal directions of the primary polygonal structure to the nominal thickness 87 of the linkages 82 that define the primary polygonal structure. In some embodiments, the void-to-thickness ratio is in the range of 3.0 to 4.5 inclusive; in some embodiments, in the range of 3.5 to 4.0 inclusive; in some embodiments, in the range of 3.7 to 3.8 inclusive.

In some embodiments, the open cells 76 can be characterized dimensionlessly as a length-to-void ratio, defined as the ratio of the a maximum length thickness 91 of the open cell butt pad 44 in the longitudinal directions to the internal dimension 87 in the longitudinal directions of the primary polygonal structure. In some embodiments, the length-to-void ratio is in the range of 2.5 to 4.5 inclusive; in some embodiments, in the range of 3.0 to 4.0 inclusive; in some embodiments, in a range of 3.3 to 3.7 inclusive; in some embodiments, in the range of 3.4 to 3.6 inclusive.

Referring to FIGS. 4A and 4B, depictions of the open cell butt pad 44 in operation are presented in an uncompressed and a partially compressed state, respectively, in an embodiment of the disclosure. The depictions of FIGS. 4A and 4B visually represent the results of a finite element analysis (FEA) model. A proximal boundary condition 92 emulating the interaction of an operator is imposed on the shouldered face or proximal face 55 of the end cap portion 66, and a distal boundary condition 94 emulating coupling with the buttstock 42 is imposed on the distal face 68 of the open cell butt pad 44. For the depicted embodiment, the open cells 76 of the open cell structure 74 extend side-to-side (i.e., parallel to the y-axis of FIG. 1). It is noted that the open cells 76 may extend in any direction lateral to the actuation axis 49 with similar effect (i.e., in any direction parallel to the y-z plane of FIG. 1).

For the FEA analysis, arbitrary force of 10 N was modeled to create a deformation profile. For illustrative purposes, the deformations were amplified 100-fold to arrive at the depiction of FIG. 4B. While some bending deformation of the linkages 82 is evident, the primary mode of the overall deformation of the hexagonal structure 80 is rotation of the linkages 82 about the junctions 84 of the lattice structure 78. Most of the perpendicular linkages 82*a* remain substantially perpendicular, with exceptions being those linkages 82*a* aligned with the discontinuity of the proximal boundary condition 92 relative to the distal boundary condition 94. The canted linkages 82*b* rotate substantially about their respective junctions 84.

Functionally, the effect is to produce an elongation of the open cells 76 of the hexagonal structure 80 in a lateral direction. In this way, the open cell butt pad 44 undergoes a nominal compression δ (FIG. 4B) without substantial compression of the material that comprises the lattice structure 78. The rotation of the linkages and elongation of the open cells mitigates the non-linearity and attendant shock abruptness of the compressible materials of certain conventional butt pads.

As a system, when the modified firearm 30 is fired, the receiver 34 and slide member 36 recoil to produce simultaneous deformations of the biasing element 48 and the butt pad assembly 43, wherein the deformation of the biasing element 48 and the butt pad assembly 43 are substantially proportionate to each other throughout a recoil event. Herein, a "recoil event" is a recoil of the recoil reduction system caused by discharge of the connected firearm. The recoil event is further characterized as having a "recoil stroke" during which the biasing element 48 and the butt pad assembly 43 undergo increasing compression from a battery configuration to a maximum compressed state for the recoil stroke, and a "return stroke" during which the biasing element 48 and the butt pad assembly 43 undergo increasing expansion from the a maximum compressed state in returning to the battery configuration.

By maintaining the linearity of the compression of the butt pad 44 (or more generally, the butt pad assembly 43) throughout the recoil event, the recoil force imparted by the butt pad against the shoulder and by the handgrip against the hand extended over the entire time interval of the recoil stroke of the recoil event, as opposed to a more abrupt recoil force that is experienced by compression and subsequent structural collapse of softer, conventional butt pads.

In operation, during a recoil event, the slide member 36 is thrust against the biasing element 48 which exerts a recoil force against the buttstock 42. Typical and non-limiting impulse forces generated by conventional firearms range from 500 N to 2500 N (112 lbf to 560 lbf). Some of the recoil force is absorbed by (i.e., causes deformation of) the biasing element 48, whereas some of the recoil force is absorbed by the open cell butt pad 44. The deformation of the biasing element 48 and the open cell butt pad 44 can each be characterized in terms of compressive displacement parallel to the actuation axis 49. In various embodiments, the biasing element 48 is adapted for a compressive displacement that is at least 1.5 times and not more than 5 times a compressive displacement of the open cell butt pad 44 during firing of the modified firearm 30. In one embodiment, the biasing element 48 is adapted for a compressive displacement that is at least 2 times and not more than 4 times a compressive displacement of the open cell butt pad 44 during firing of the modified firearm 30. In one embodiment, the open cell butt pad 44 is adapted for a compressive displacement that is at least 8 mm and not more than 20 mm.

The biasing element 48 and the open cell butt pad 44 can also be characterized in terms of their respective spring rates. That is, biasing element 48 can be said to have a first spring rate, and the open cell butt pad 44 can be said to have a second spring rate. Herein, a "spring rate," also known as a "spring constant," of a component is defined by a ratio of the force to the compressive displacement of the component caused by application of that force, in accordance with Hooke's law.

In still other embodiments, one or both of the biasing element 48 and the open cell butt pad 44 is a dampening device (not depicted), such as a hydraulic damper or a pneumatic damper. Dampening devices are generally not characterized in terms of a spring rate, but rather in terms of an "energy capacity," having units of energy (e.g., joules or ft-lbf). A compressive displacement of such dampening devices during a recoil event can be calculated, such that the dampening device is sized to provide a desired compressive displacement. Herein, a "compressive displacement" is the change in length of a compressed component, such as the biasing member 48 or the open cell butt pad 44, in a direction parallel to the actuation axis 49 of the respective component during a recoil event. In various embodiments, the biasing element 48 is a dampening device having an energy capacity in the range of 30 to 100 Joules inclusive to provide a compressive displacement in the range of approximately 10 to 30 mm, depending on the impulse force.

The butt pad assembly 43 is not limited to the open cell butt pad 44. That is, a "butt pad" is a generic term for any structure that is affixed to the proximal end 46 of the buttstock 42. Alternative butt pads to the open cell butt pad 44 include, but are not limited to, coil-spring loaded plates and gel cores. Such alternative butt pads may be engineered to possess the displacement characteristics of the open cell butt pad 44 and to work in cooperation with the biasing element 48 to provide the same recoil effect as the disclosed embodiments.

In the depicted embodiment, the buttstock 42 defines a longitudinal bore 102 that extends along the actuation axis 49 and is accessible from a distal end 104 (FIG. 2) of the buttstock 42. In the depicted embodiment, a buffer tube 108 is disposed within the longitudinal bore 102. Herein, "longitudinal" is defined as being in a direction that is parallel to the actuation axis 49, whereas "lateral" is defined as being in any direction that is perpendicular to the actuation axis 49.

In further reference to FIGS. 2 and 3, the hand grip assembly 50 further defines a rearward opening 182. In one embodiment, a threaded insert 184 including internal threads 185 is molded into the rearward opening 182 of the hand grip assembly 50. In one embodiment, a spring tube 186 is disposed in the threaded insert 184, the spring tube 186 having an open forward end 188 and a bearing structure 192 at a rearward end 194. The bearing structure 192 may be, for example, an internal lip or flange, or a bridging structure such as a closed end (as depicted) or one or more laterally-extending rods. In the depicted embodiment, the forward end 188 includes exterior threads 196 that threadably engage with the threaded insert 184. The biasing element 48 is disposed in the spring tube 186 and extends into the rearward portion of the hand grip assembly 50, the biasing element 48 engaging both the bearing structure 192 of the spring tube 186 and a rearward face 142 of the slide member 36.

A front end portion 197 of the buffer tube 108 includes external threads 198 that mate with the internal threads 185 of the threaded insert 184 of the hand grip assembly 50. A castle nut 202 also engages the external threads 198 of the buffer tube 108, so that, when tightened against the hand grip assembly 50, the castle nut 202 imparts an axial load between the external threads 198 of the buffer tube 108 and the internal threads 185 of the threaded insert 184. During assembly, a bonding paste, such as LOCTITE®, may be applied between the external threads 198 of the buffer tube 108 and the internal threads 185 of the threaded insert 184. The bonding paste and the axial force exerted by the castle nut 202 act to resist rotation between the buffer tube 108 and the hand grip assembly 50.

Figure 5:
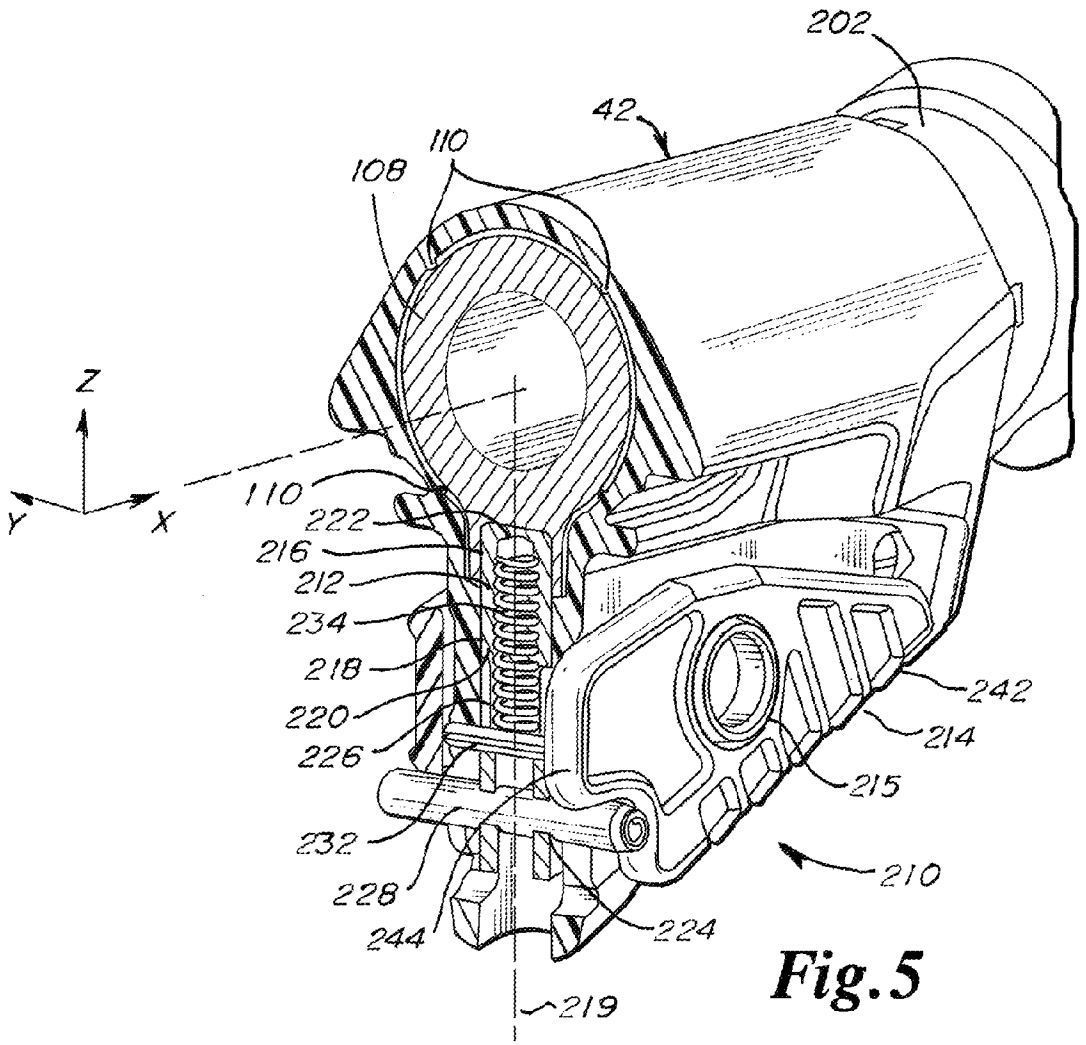
FIG. 5 is a partial sectional view of a stock length adjustment mechanism in an unactuated state in an embodiment of the disclosure.

Referring to FIG. 5 and again to FIGS. 2 and 3, a stock length adjustment mechanism 210 for the recoil reduction system 32 is depicted in an embodiment of the disclosure. The stock length adjustment mechanism includes an adjustment pin 212, an adjustment lever 214 coupled to the buttstock 42 about a pivot 215, and a plurality of adjustment notches 216 (FIG. 2) formed on the buffer tube 108. Portions of the adjustment lever 214 are outlined in FIG. 2 in phantom. In one embodiment, the adjustment pin 212 is housed within a bore 218 defined in the buttstock 42, the bore 218 defining a pin actuation axis 219 that is parallel to the z-axis. The adjustment pin 212 and bore 218 are dimensioned so that the adjustment pin 212 can slide within the bore 218. In various embodiments, the adjustment pin 212 comprises a hollow tube 220 with a closed or restricted diameter end portion 222. The hollow tube 220 may define a circular through hole 224 and a slotted through hole 226.

In various embodiments, a cross pin 228 is disposed in the circular hole 224 of the adjustment pin 212, the cross pin 228 extending parallel to the y-axis. In some embodiments, an anchor pin 232 extends across the bore 218 and through the slotted through hole 226, the anchor pin 232 being perpendicular to the pin actuation axis 219 and oriented in a direction parallel to the y-axis. The anchor pin 232 is secured on both ends to the buttstock 42. In the depicted embodiment, as spring 234 is disposed in the hollow tube 220, captured between the end portion 222 and the anchor pin 232.

In the depicted embodiment, the bore 218 is aligned with a selected one of the plurality of adjustment notches 216, such that the adjustment pin 212 extends out of the bore 218 and into selected notch 216. In FIG. 2, the adjustment pin 212 is in the forward-most of the adjustment notches 216, so that the effective length of the recoil reduction system 32 is at its shortest.

In operation, to change the length adjustment of the recoil reduction system 32, a forward end 242 of the adjustment lever 214 is pressed toward the buttstock 42, causing the lever 214 to rotate about pivot 215 so that a rearward end 244 of the lever rotates away from the buttstock 42. The rotation causes the rearward end 244 of the adjustment lever 214 exerts a force on the cross pin 228 which transfers to the adjustment pin 212, so that the adjustment pin 212 becomes dislodged from the adjustment notch 216. With the adjustment pin 212 dislodged from the adjustment notch 216, the buffer tube 108 may be slid longitudinally within the bore 102 of the buttstock 42 to establish a different overall length of the recoil reduction system 32.

During actuation of the adjustment pin 212, the slotted through hole 226 slides over the stationary anchor pin 232 as the end portion 222 is drawn closer to the anchor pin 232. The spring 234 becomes compressed between the end portion 222 and the anchor pin 232. The compression biases the adjustment pin 212 so that, upon release of the adjustment lever 214, the adjustment pin 212 is urged back into contact with the buffer tube 108 and, perhaps after some additional positioning of the buffer tube 108 within the bore 102, into one of the adjustment notches 216.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims for the embodiments of the inventions, it is expressly intended that the provisions of 35 U.S.C. 112(f) are not to be invoked unless the specific terms "means for" or "step for" are recited in the respective claim.

What is claimed is:

1. A recoil reduction system, comprising:

a buttstock; a slide member for coupling to a receiver; a biasing element operatively coupled with said buttstock and said slide member; and a butt pad coupled to a proximal end of said buttstock, said butt pad including a lattice structure defining a plurality of open cells that are exposed to ambient air; wherein:

the biasing element has a first maximum compressive displacement during a recoil event; the butt pad has a second maximum compressive displacement during the recoil event; and a ratio of the first maximum compressive displacement to the second maximum compressive displacement is at least 1.5 and not greater than 5.

2. The recoil reduction system of claim 1, wherein the ratio of said first maximum compressive displacement to said second maximum compressive displacement is at least 2 and not greater than 4.

3. The recoil reduction system of claim 1, wherein said biasing element has a maximum compressive displacement during the recoil event that is at least 8 mm and not more than 20 mm.

4. The recoil reduction system of claim 1, said biasing element defining a first spring rate over a first compressive displacement length, said butt pad defining a second spring rate over a second compressive displacement length, said second spring rate being at least 2 times and not more than 4 times said first spring rate.

5. The recoil reduction system of claim 1, comprising a buffer tube disposed in a longitudinal bore defined within said buttstock, said longitudinal bore being accessible from a distal end of said buttstock, wherein said biasing element is disposed in said buffer tube.

6. A recoil reduction system, comprising:

a buttstock; a slide member for coupling to a receiver; a biasing element operatively coupled with said buttstock and said slide member; and a butt pad coupled to a proximal end of said buttstock; a hand grip assembly mounted to said buttstock, said hand grip assembly and said slide member being configured for translation of said slide member in a proximal direction relative to said hand grip assembly during a recoil event wherein:

the biasing element has a first maximum compressive displacement during a recoil event; the butt pad has a second maximum compressive displacement during the recoil event; and a ratio of the first maximum compressive displacement to the second maximum compressive displacement is at least 1.5 and not greater than 5.

7. The recoil reduction system of claim 6, comprising a tube that houses said biasing element, said tube being operatively coupled to said hand grip assembly and having a mounting plate at a proximal end and defining an opening at a distal end, said biasing element registering against said mounting plate during said recoil event.

8. The recoil reduction system of claim 6, wherein said slide member is disposed within said hand grip assembly.

9. The recoil reduction system of claim 8, wherein said butt pad includes a lattice structure defining a plurality of open cells.

10. The recoil reduction system of claim 8, said biasing element defining a first spring rate over a first compressive displacement length, said butt pad defining a second spring rate over a second compressive displacement length, said second spring rate being at least 2 times and not more than 4 times said first spring rate.

11. A recoil reduction system, comprising:

a buttstock; a slide member for coupling to a receiver; a biasing element operatively coupled with said buttstock and said slide member; and a butt pad coupled to a proximal end of said buttstock; wherein:

said butt pad includes a lattice structure defining a plurality of open cells that are exposed to ambient air, said lattice structure defining a porosity of at least 85% and not more than 92%, the porosity being a ratio of an air volume of air occupying the open cells to a total volume of the lattice structure; the biasing element has a first maximum compressive displacement during a recoil event; the butt pad has a second maximum compressive displacement during the recoil event; and a ratio of the first maximum compressive displacement to the second maximum compressive displacement is at least 1.5 and not greater than 5.

12. The recoil reduction system of claim 11, further comprising a hand grip assembly mounted to said buttstock, said hand grip assembly and said slide member being configured for translation of said slide member in a proximal direction relative to said hand grip assembly during said recoil event.

13. The recoil reduction system of claim 12, further comprising a tube that houses said biasing element, said tube being operatively coupled to said hand grip assembly and having a mounting plate at a proximal end and defining an opening at a distal end, said biasing element registering against said mounting plate during said recoil event.

14. The recoil reduction system of claim 12, wherein said slide member is disposed within said hand grip assembly.

15. The recoil reduction system of claim 11, said biasing element defining a first spring rate over a first compressive displacement length, said butt pad defining a second spring rate over a second compressive displacement length, said second spring rate being at least 2 times and not more than 4 times said first spring rate.

* * * * *